US005742259A

United States Patent [19]

Annamaa

[11] Patent Number: 5,742,259

[45] Date of Patent: Apr. 21, 1998

[54] RESILIENT ANTENNA STRUCTURE AND A METHOD TO MANUFACTURE IT

[75] Inventor: Petteri Annamaa, Oulu, Finland

[73] Assignee: LK-Products Oy, Kempele, Finland

[21] Appl. No.: 630,040

[22] Filed: Apr. 2, 1996

[30] Foreign Application Priority Data

Apr. 7, 1995 [FI] Finland ..... 951670

[51] Int. Cl.[6] ..... H01Q 1/36

[52] U.S. Cl. ..... 343/895; 343/702; 343/906; 29/600

[58] Field of Search ..... 343/702, 872, 343/873, 715, 901, 895, 906; 29/600

[56] References Cited

U.S. PATENT DOCUMENTS

| | | | |
|---|---|---|---|
| 3,852,759 | 12/1974 | Felsenheld et al. | 343/895 |
| 4,435,713 | 3/1984 | Gasparaitis et al. | 343/895 |
| 4,725,395 | 2/1988 | Gasparaitis et al. | 343/873 |
| 4,800,395 | 1/1989 | Balzano et al. | 343/895 |
| 4,867,698 | 9/1989 | Griffiths | 343/702 |
| 5,231,412 | 7/1993 | Eberhardt et al. | 343/895 |
| 5,274,393 | 12/1993 | Scott | 343/895 |
| 5,341,149 | 8/1994 | Valimaa et al. | 343/873 |
| 5,436,633 | 7/1995 | Liu | 343/895 |
| 5,451,974 | 9/1995 | Marino | 343/895 |

FOREIGN PATENT DOCUMENTS

| | | | |
|---|---|---|---|
| 0 370 715 | 5/1990 | European Pat. Off. | H01Q 1/12 |
| 0 632 603 | 1/1995 | European Pat. Off. | H04B 7/00 |

*Primary Examiner*—Michael C. Wimer
*Assistant Examiner*—Tan Ho
*Attorney, Agent, or Firm*—Darby & Darby

[57] ABSTRACT

The invention relates to the structure and manufacturing method of a helix antenna suitable for use in mobile phones and other radio devices. The helix part of the antenna is made of a resilient material, like stainless spring steel wire, and its lower part is wound into a support coil more dense than the rest of the helix. The antenna includes a connector part through which it is electrically and mechanically connected to a radio device. The upper end of the connector part is formed such that when the helix part is fitted onto it, the support coil will undergo a change of form which generates a spring force that keeps the helix electrically and mechanically connected to the connector part. An elastic protective material is fitted onto the helix, attached by melting to a special joint surface in the connector part.

17 Claims, 2 Drawing Sheets

RESILIENT ANTENNA STRUCTURE AND A METHOD TO MANUFACTURE IT

BACKGROUND OF THE INVENTION

1. Field of the Invention

This invention relates to the structure of a small radio-frequency helix or helical antenna and a method for manufacturing said antenna structure. The antenna structure will be hereafter called a helix antenna.

2. Discussion of the Related Art

In current radio frequency applications, such as mobile phones, the antenna structure is a significant factor from the point of view of the appearance, durability and ease of operation of the device. The manufacturing costs also contribute to the price of the radio device. Since modern mobile phones are small and lightweight, the antenna, too, should be small. The antenna should not be easily damaged, should the user accidentally drop his/her phone; on the contrary, the antenna as a flexible element may prevent the phone itself from being damaged. In a large-scale series production of telephones the antenna should be economical and easy to manufacture, which can be interpreted to mean that the antenna should have only a few parts, the parts should be simple in form, and the mechanical tolerances should not be unreasonably exacting.

The helix antenna is a widely known antenna structure that is smaller than e.g. a rod antenna with equal performance and which, thus, is the usual choice for the antenna of a modern mobile phone. A helix antenna according to prior art comprises a conductor wound into a cylindrical coil, ie. the helix, which includes a short leg part bent to the middle and downwards and a connector coupled to the leg part of the helix by soldering for example. The inner part of the antenna may be supported by forming a special supporting part inside the helix. Externally, the helix part is usually protected with an elastic protector which may be, for example, an injectionmoulded cover or a rubber sleeve glued to the helix part and the upper part of the connector.

The dimensions of the helix are determined as follows: the length of the helix wire is a certain fraction of the wavelength of the electromagnetic wave at the operating frequency, like $\lambda/4$ or $5\lambda/8$. The desired length and thickness of the antenna determine how closely the cylindrical coil comprising said amount of wire is wound. The connector, to which the helix is attached, includes means for connecting the antenna mechanically and electrically to a radio device.

FIG. 1 shows a conventional structure of a helix antenna and the method to manufacture it. First, it is made a connector 2*a* and a helix 3*a*separately, in phase I. Next, in phase II, the connector and helix are joined to each other by soldering, for example. Then the helix is supported e.g. by placing a support 7*a* inside the helix, phase III and in phase IV the helix is encapsulated in an outer cover 4*a*. Alternatively, after the joining phase II, a separate rubber sleeve 4*a* can be glued on the structure to function as an outer cover, joined to the upper part of the connector, phase III'. The manufacturing process comprises several phases and the soldering of the connector 2*a* and helix 3*a*, phase II, as well as the glueing of the rubber sleeve 4*a*, phase III', are particularly sensitive. The solder between the helix and connector is susceptible to bending, shocks, and other mechanical strain.

SUMMARY OF THE INVENTION

The object of this invention is to provide an antenna structure and a method to manufacture it, in which the helix part is attached to the connector part of the antenna in a simple and reliable manner, and the whole constituted by these parts is protected with an elastic cover so that an antenna manufactured according to the method is mechanically durable and suitable for a mobile phone.

The object is achieved by manufacturing the helix part using a resilient and conductive material, arranging the upper end of the connector part such that the helix part is attached to it with a coupling that makes use of the resilience characteristic, and by attaching an elastic protective part on the helix part and connector part by melting.

It is characteristic of the antenna structure according to the invention that the connector part is a solid piece made of a conducting material and at the connector part side of the helix there is a part that is wound more densely than the rest of the helix, ie. a support coil, which is connected to the connector part and exerts a spring force against it which prevents the connector part from being disconnected from the helix and forms at the radio frequency a low-impedance electric connection between the helix and the connector part.

It is characteristic of the method according to the invention that the connector part is manufactured from a solid piece of a conducting material and the connector part side of the helix is wound into a support coil more dense than the rest of the helix, and when the helix is connected to the connector part, an elastic change of form occurs in the support coil, which generates in the helix material a spring force applied to the connector part, preventing the connector part from being disconnected from the helix and forming at the radio frequency a low-impedance electrical connection between the helix and the connector part.

An advantage of the method according to the invention is that if and when the combined helix and connector parts should be covered by a dielectric protective cover, no glueing together of parts is needed, and the helix element and connector part need not to be injection moulded into plastic as in prior art methods. The dielectric cover of the structure may be fabricated separately, and the antenna is preferably assembled by heating the metal parts, that is, the helix element and the connector part, and by inserting them into the dielectric cover, whereby the dielectric material melts onto the hot metal surface of the connector part.

BRIEF DESCRIPTION OF THE DRAWINGS

The antenna according to the invention and its manufacturing method are described below in geater detail with the help of examples illustrating preferable embodiments, with reference to the enclosed drawing, where.

DETAILED DESCRIPTION OF THE PREFERRED EMBODIMENTS

Figure 1:
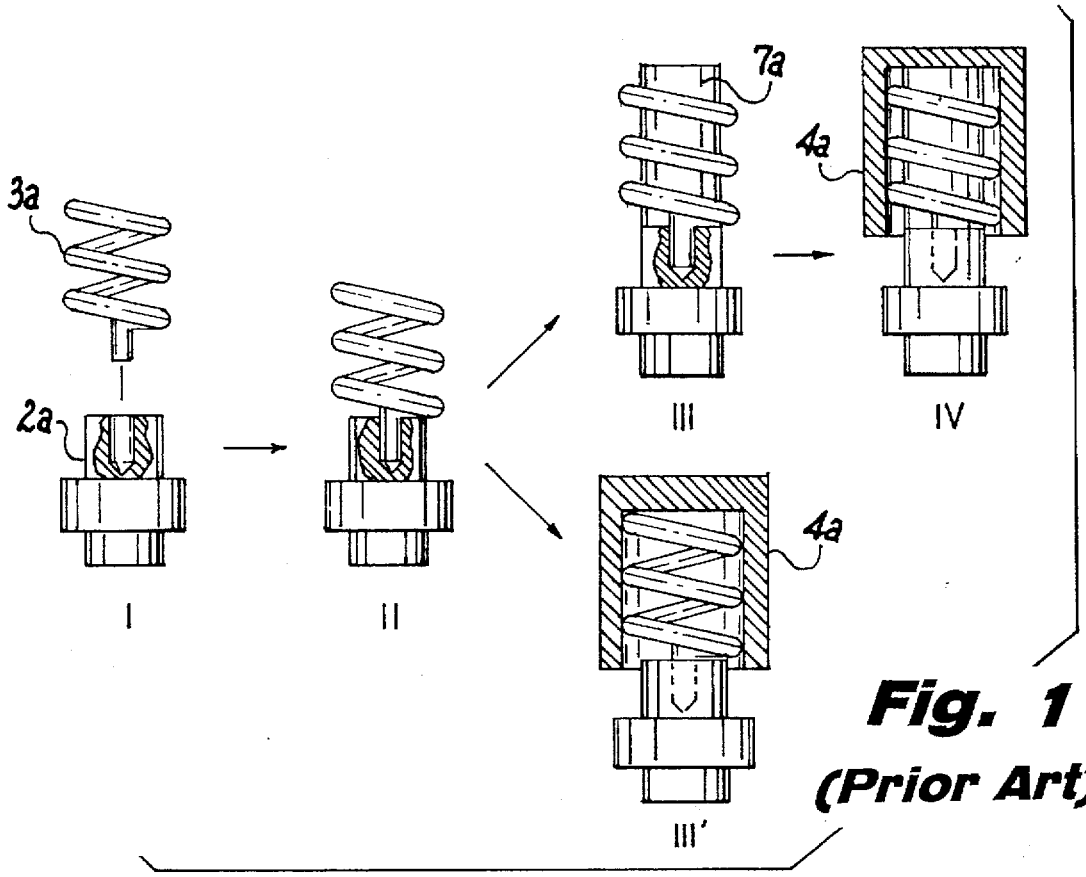
Fig. 1 (Prior Art)
FIG. 1 illustrates two alternative, known manufacturing methods for a helix antenna.

In the drawing, corresponding parts are marked with the same reference numbers.

For the helix part to be able to serve as an antenna, it has to be of a conducting material, preferably metal. As regards the antenna function, there are no big differences between different metals but e.g. stainless spring steel is almost as good an antenna material as copper and silver which have better electrical conductivity; characteristics. The advantage of steel is its resilience and excellent mechanical durability. This fact is known and steel has indeed been used in helix antennas so that bending or other improper handling of the antenna would cause no permanent deformation of the helix. To improve conductivity, the steel wire may be coated with copper or silver, for example. Other possible wire materials include various phosphor bronze alloys, like $CuSn_6$ and CuBe. A still further wire material is berylium copper. In this invention it has been realized that the resilience of the helix material can also be utilized to produce a simple but sturdy and reliable joint between the helix part and the connector part.

Figure 2:
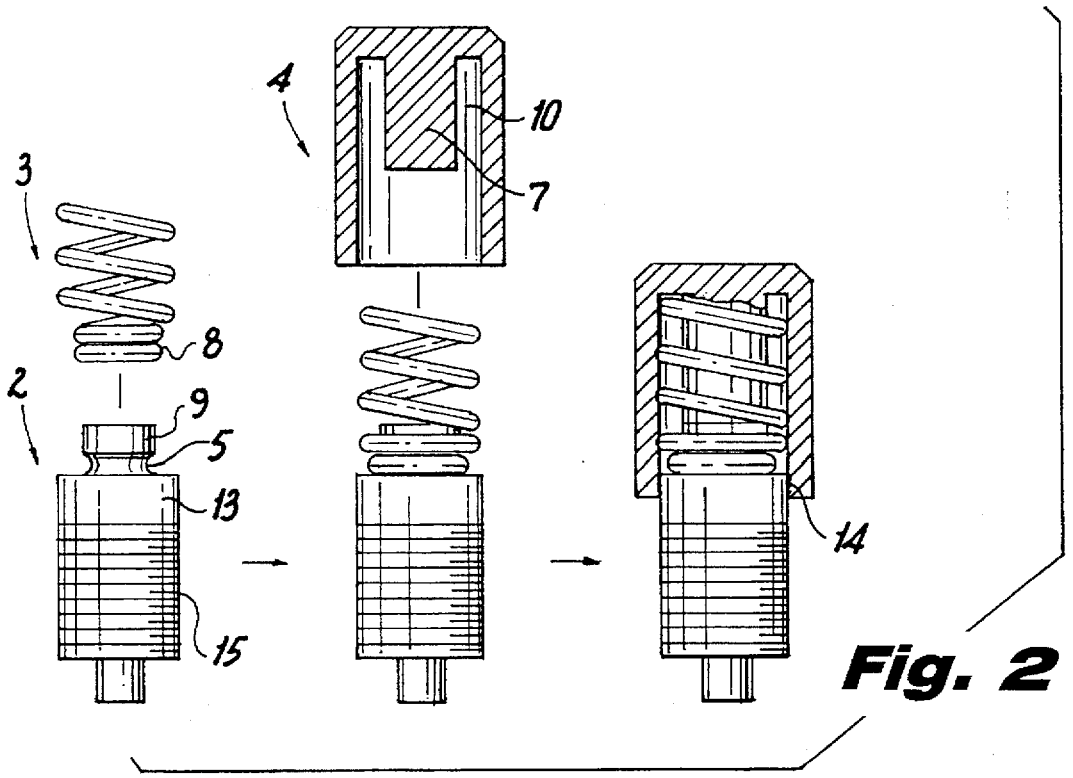
FIG. 2 illustrates an embodiment of the helix antenna according to the invention.
Figure 3:
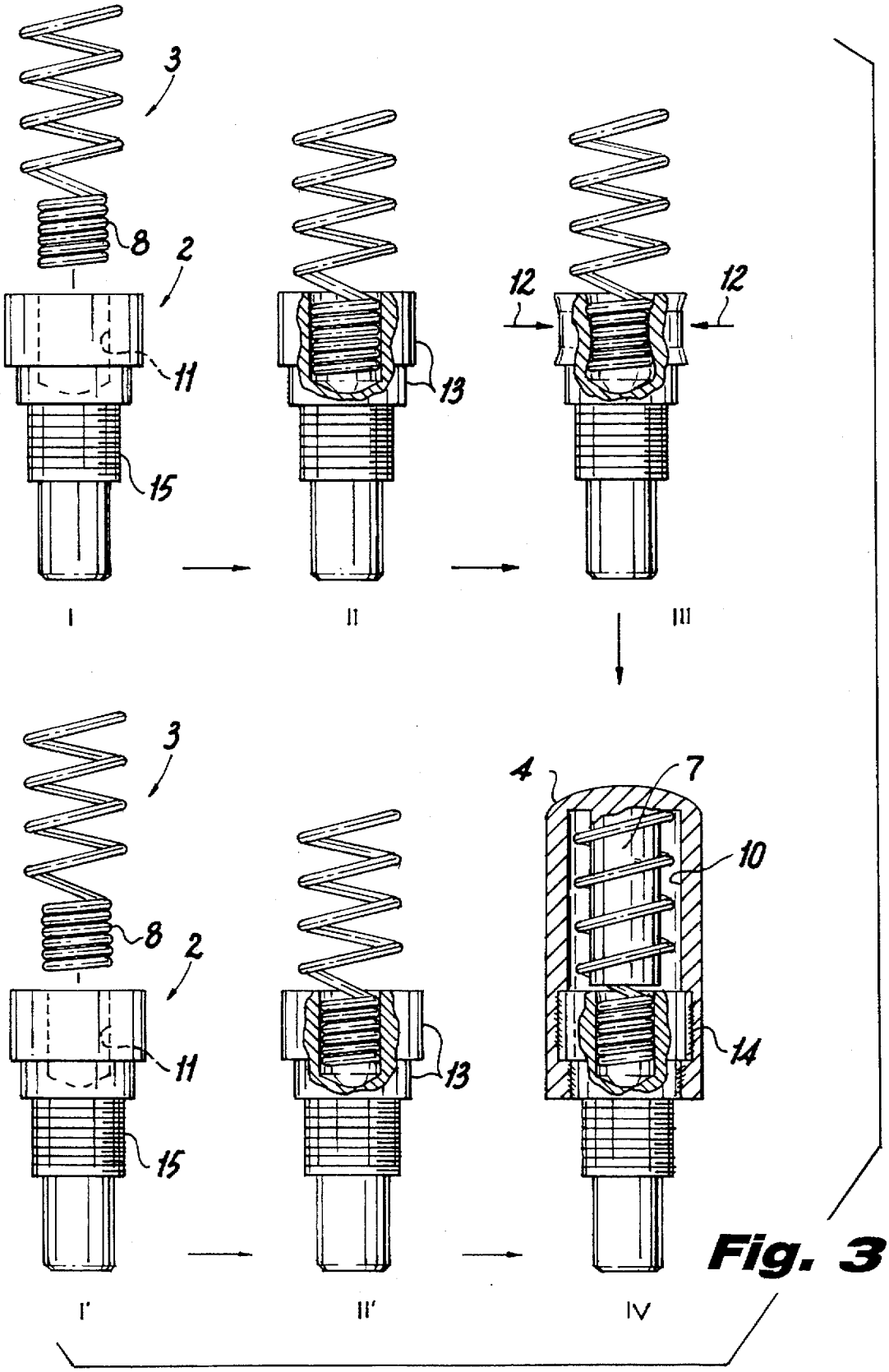
FIG. 3 illustrates another embodiment of the helix antenna according to the invention.

According to the invention, no leg part bent to the middle and downwards, as described above, is formed at the lower end of the helix part but the lower part of the helix coil is wound for a few turns in such a manner that it is more dense and has a smaller diameter than the rest of the helix coil, as shown in FIGS. 2 and 3. This more closely wound section will be hereafter called a support coil 8. The connector part 2 is made of any conductive material, preferably brass, copper, or aluminium, and its upper end 9; 11 is designed such that the fitting together of it and the helix part results in a change of form in the support coil 8, which, because of the resilience of the helix material, produces a spring force against the connector part 2. The friction caused by that spring force is so high that it holds the helix part tightly against the connector part. In addition, the spring force ensures that there is a good galvanic contact between the helix part and connector part and a low-loss signal path for the RF signal transmitted and received through the antenna. The effect of the spring force may be enhanced by forming a groove 5 at the upper end of the connector part before fitting the parts together, into which the support coil or part of it is locked, or by crimping part of the upper end of the connector part particularly tightly against the support coil after the parts have been fitted together.

FIG. 2 shows a preferable embodiment to implement the fitting together of the helix part and connector part, as described above. In the embodiment, the upper end of the connector part 2 is a cylindrical pin 9 whose diameter is bigger than the inner diameter of the support coil. A groove 5 is formed at the foot of the pin. The helix part is fitted to the connector part so that the support coil 8 is pressed onto the pin 9. The support coil has two to four tightly wound turns, and the lowest of the turns is locked onto the groove 5. Since the diameter of the pin 9 is bigger than the original inner diameter of the support coil 8, the fitting will stretch the support coil and produce in the joint a spring force against the pin, and the friction caused by the spring force is enhanced by the locking of the lowermost turn onto the groove 5.

FIG. 3 shows another preferable embodiment of the invention. In this embodiment, the upper end of the connector part includes a cylindrical cavity 11 whose inner diameter is the same as or smaller than the outer diameter of the support coil 8 and whose depth is the same as the height of the support coil 8. The helix part is fitted into to the connector part so that the support coil is pushed inside the cavity 11. If in a normal temperature the inner diameter of the cavity is smaller than the outer diameter of the support coil, as in phases I' and II', the connector part has to be heated in the fitting phase, thus temporarily increasing the diameter of the cavity. As the connector part cools down, it is pressed tightly around the support coil. Another alternative is to make the diameter of the cavity 11 identical to or slightly bigger than the diameter of the support coil 8 and, after the fitting, crimp the connector part at the point of the cavity, thus making a crimp connection 12. This method is illustrated by phases I, II, and III. Naturally, crimping may also be used to secure the fitting by heating performed in phase II'. In both cases, the pressing force against the support coil caused by the wall of the cavity produces a change of form according to the invention in the resilient helix material. The resulting spring force is directed against the wall of the cavity and makes sure that the attachment holds and provides a good RF conductivity in the same manner as in the first embodiment.

In an antenna according to the invention, the protective part 4 which belongs to the antenna structure is made of a non-conductive elastic material, preferably a rubber or plastic alloy which is suitable for injection moulding or similar advantageous manufacturing method and which can be melted onto a metal surface. The protective part 4 is formed according to FIGS. 2 and 3 such that it has a cavity 10 corresponding to the length of the helix part and possibly a cylindrical middle pin 7 in the middle of the cavity. The protective part is fitted onto the helix and connector part so that the helix 3 goes inside the cavity 10 of the protective part and the middle pin 7 is pushed inside the helix 3. The middle pin makes the structure sturdier and prevents the helix coil from being compressed sideways if it becomes the object of a strong lateral force, as, for example, when the antenna is caught between a door. The middle pin also puts an electric load on the antenna, which causes the operating frequency of the antenna to become lower when the middle pin becomes longer, or in other words, the farther the middle pin goes inside the helix coil, the lower the operating frequency. This phenomenon can be utilized in the fine-tuning of the antenna by adjusting the length of the middle pin such that the antenna will operate at the optimal frequency.

The protective part is attached onto the helix part and connector part through a melt joint 14. In a preferable embodiment of the attachment method the protective part is inside an external mould supporting it and the whole constituted by the helix and connector part is pushed inside the protective part and the connector part is heated, whereby the lower end of the protective part melts and becomes attached to the surface of the connector part below the helix-connector part joint. The heating of the helix and connector pans may also take place before their insertion into the protective part. Also in this version of the method, the protective part must be supported from outside during the insertion. For the purpose of joining by melting a special joint surface 13 is formed on the connector part. The melting rubber or plastic material must not boil when heated, since gas formation caused by boiling prevents the formation of a durable joint. A thread or other arrangement in the connector part with which it is attached to a phone remains in a completed antenna outside the protective part.

The antenna structure described above and illustrated by two embodiment examples comprises only three parts: a connector part, a helix part, and a protective part. All parts are simple in form and easy and quick to manufacture: the helix part can be made of a steel wire by winding, the connector part from a cylindrical blank by lathing, and the protective part by injection moulding. The mechanical tolerances are not rigorous, since the pans attached to each other with spring, crimp, and melt connections do not have to be mechanically perfectly compatible before joining. A typical mechanical tolerance in the antenna structure described is 0.1 mm. It has been found that as far as mechanical durability is concerned a joint based on a spring force is better than a conventional soldered joint, and its use eliminates the laborious soldering phase in the manufacturing process. In addition, the protective part may be attached to the connector part by melting, without having to fear that solders will break.

A substantial part of the inventiveness of the structure is the discovery that a coupling meant for an RF frequency does not have to be soldered or crimped onto the straight portion of the helix conductor but the coupling may be based on a spring force, which is available because, for other reasons, the helix part is made of a resilient material. There is no need at all to form a straight portion, as in prior art, in the lower end of the helix.

We claim:

1. An antenna for a radio-frequency communication device, comprising a helix formed of a wire of a resilient material wound into a cylindrical coil, and a connector part coupled electrically and mechanically to it, the connector part is a solid piece made of a conducting material and at the side of the helix adjacent to the connector part there is a part which is wound more closely than the rest of the helix, thus forming a support coil which is connected to the connector part and applies a spring force against it which prevents the connector pan from being disconnected from the helix.

2. The antenna of claim 1, wherein said spring force forms at the radio frequency a low-loss electric connection between said helix and said connector part.

3. The antenna of claims 1 or 2, further comprising, in addition to said helix and connector part, a layer of protective material which is a solid piece made of an elastic, non-conductive material covering the helix and being connected to the connector part through a solder joint.

4. The antenna of claim 3, wherein the connector part has a substantially cylindrical joint surface to which said protective material is attached through the solder joint.

5. The antenna of claim 1, wherein at the end of the connector part adjacent to the helix there is a substantially cylindrical pin whose diameter is bigger than the inner diameter of the support coil when the support coil is free, and the support coil is fitted onto the pin and presses it with said spring force.

6. The antenna of claim 5, wherein said pin includes a groove onto which at least one turn of the support coil is locked.

7. The antenna of claims 1 or 2, wherein at the end of the connector part adjacent to the helix there is a substantially cylindrical cavity inside which the support coil is fitted and which is crimped around the support coil in such a manner that a crimp connection is formed between the wall of the cylindrical cavity and the support coil.

8. The antenna of claims 1 or 2, wherein at the end of the connector part adjacent to the helix there is a substantially cylindrical cavity the diameter of which is smaller than the outer diameter of the support coil when the support coil is free, and inside which the support coil is fitted, and against the wall of which the support coil is pressed from inside with said spring force.

9. The antenna of claim 1, wherein the connector part includes an attachment arrangement with which the antenna is mechanically attached to a radio communication device.

10. The antenna of claim 9, wherein said attachment arrangement is a screw thread.

11. The antenna of claim 1, wherein the helix is made of stainless spring steel-based wire.

12. The antenna of claim 1, wherein the helix is made of phosphor bronze.

13. The antenna of claim 1, wherein the helix is made of beryllium copper.

14. A method for manufacturing an antenna for a communication device operating at a radio frequency, said antenna comprising a helix formed of a wire of a resilient material wound into a cylindrical coil, and a connector part coupled electrically and mechanically to it, comprising the steps of:

manufacturing the connector part from a solid piece of a conducting material, and winding the end of the helix that is adjacent to the connector part more closely than the rest of the helix to form a support coil, such that, when the helix is connected to the connector part, an elastic change of form in the support coil is provided which generates in the helix material a spring force applied to the connector part, prevents the connector part from being disconnected from the helix and forms at the radio frequency a low-impedance electric connection between the helix and the connector part.

15. The method of claim 14, further including the steps of:

manufacturing a layer of protective material as one piece of an elastic non-conductive material to protect said helix and connector part, fitting said layer of protective material onto the helix, and connecting said non-conductive material to the connector part through a solder joint.

16. The method of claims 14 or 15, fitting further including the steps of:

arranging at the helix side end of the connector part, before the connection of the helix, a substantially cylindrical cavity with walls, fitting inside the cavity the support coil and crimping the walls of the cavity around the support coil so that a crimp connection is formed between the walls of the cylindrical cavity and the support coil.

17. The method of claims 14 or 15, further including the steps of:

arranging at the helix side end of the connector part, before the connection of the helix, a substantially cylindrical cavity, the diameter of which is smaller than the outer diameter of the support coil when the support coil is free, fitting the support coil inside the cylindrical cavity, and heating the connector part so that the inner diameter of the cylindrical cavity is substantially increased.

* * * * *